US006038422A

United States Patent [19]

Loewel

[11] Patent Number: 6,038,422

[45] Date of Patent: Mar. 14, 2000

[54] TONER CARTRIDGE

[75] Inventor: Wilhelm Loewel, Reutlingen, Germany

[73] Assignee: R. & A. Leibfarth GmbH Verpackungstechnik, Pliezhausen, Germany

[21] Appl. No.: 09/337,905

[22] Filed: Jun. 22, 1999

[30] Foreign Application Priority Data

Jun. 20, 1998 [DE] Germany ..... 198 27 547

[51] Int. Cl.[7] ..... G03G 15/08

[52] U.S. Cl. ..... 399/262

[58] Field of Search ..... 399/262, 258, 399/252, 222; 222/DIG. 1, 142.5, 129; 220/506, 661, 669; 215/382, 380

[56] References Cited

U.S. PATENT DOCUMENTS

| | | | |
|---|---|---|---|
| 3,088,634 | 5/1963 | Rosekrans et al. | 222/129 X |
| 3,729,114 | 4/1973 | Mari | 220/506 X |
| 4,456,134 | 6/1984 | Cooper | 215/382 X |
| 5,071,028 | 12/1991 | Murphy | 220/669 X |
| 5,607,076 | 3/1997 | Anthony | 220/506 X |
| 5,615,791 | 4/1997 | Vatelot et al. | 215/382 |
| 5,895,149 | 4/1999 | Weed | 399/262 |
| 5,915,155 | 6/1999 | Shoji et al. | 399/262 |

FOREIGN PATENT DOCUMENTS 4-477 1/1992 Japan .

*Primary Examiner*—Susan S. Y. Lee
*Attorney, Agent, or Firm*—Michael J. Striker

[57] ABSTRACT

A toner cartridge has a hollow-cylindrical main body which is rotatably driveable about is longitudinal axis and has two opposite end sides, the main body being provided in one of the end sides with an outlet opening having a smaller diameter than a diameter of a remaining part of the main body, and at least one substantially truncated-cone-shape, hollow inner body arranged in an interior of the main body, the inner body having one end with a smaller diameter opening into the outlet opening of the main body and another end with a greater diameter connected with the other end side of the main body, the inner body in a region of the end of a greater diameter having a radial recess provided in a wall of the inner body, the main body on its inner surface being provided with a spiral-shaped formation which during rotation of the cartridge transports the toner to the recess of the inner body, the inner body on its inner surface being provided with a spiral-shaped formation which during rotation of the cartridge transports the toner to the recess from the outlet opening.

7 Claims, 1 Drawing Sheet

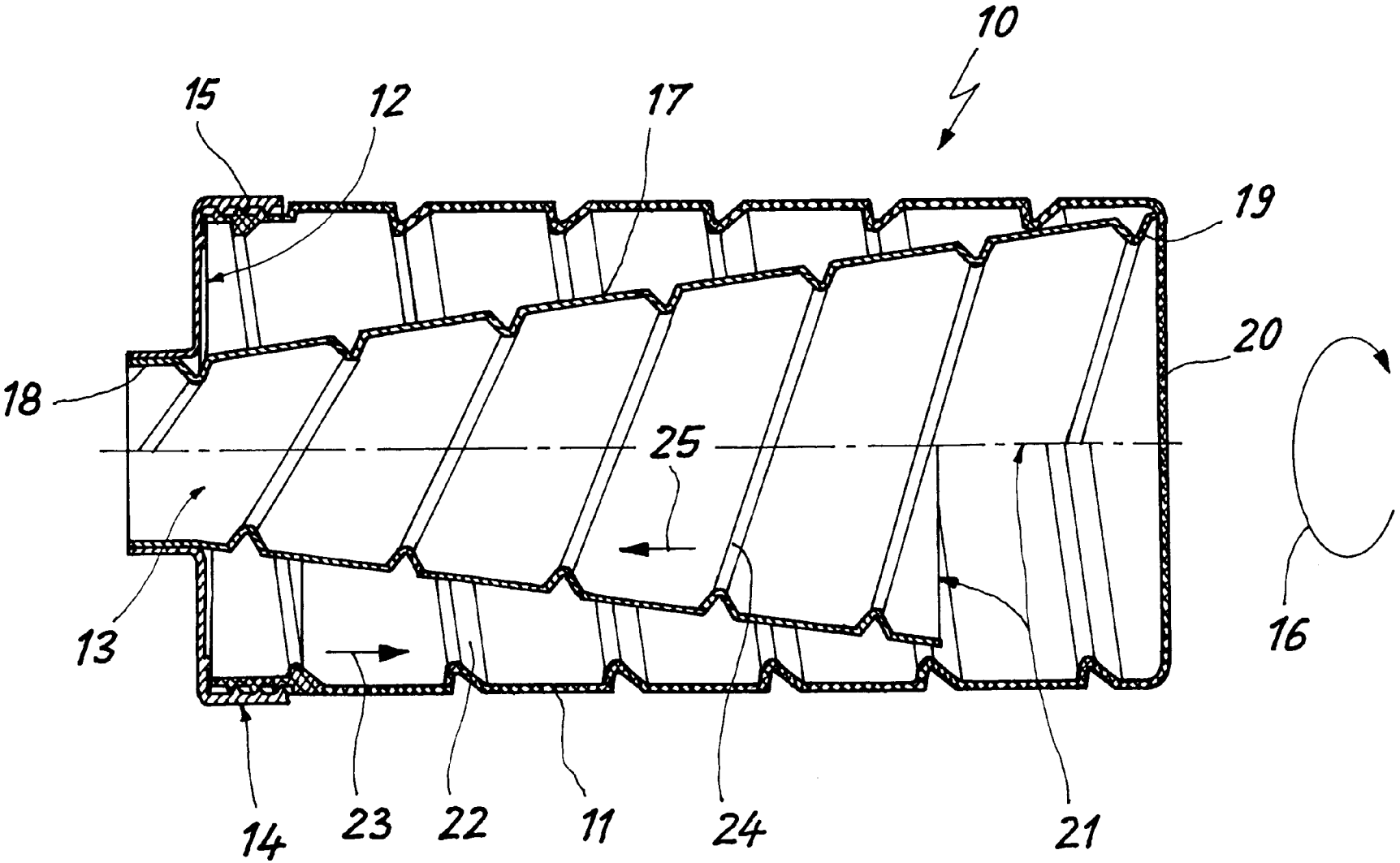
10
11
12
13
14
15
16
17
18
19
20
21
22
23
24
25

TONER CARTRIDGE

BACKGROUND OF THE INVENTION

The present invention relates to a toner cartridge.

More particularly, it relates to a toner cartridge which has a hollow-cylindrical main body rotatable about a longitudinal axis, and is provided at one of its end sides with an outlet opening for a toner with a smaller diameter than the main body.

Such toner cartridges are known for long time both for copiers as well as for fax machines and printers. They are inserted horizontally into the device with the end provided with the outlet opening and driven rotatably, so that toner powder is discharged through the outlet opening into the device. Since the outlet opening has a smaller diameter than the body, in these cartridges there is a problem of transporting of the residual toner from the outlet opening from the increasingly emptying cartridge. Several solutions have been proposed, such as for example a helical transporting vane in the region of the outlet opening which can transport the toner powder from the periphery of the hollow-cylindrical main body to the outlet opening. The known solutions are only conditionally satisfactory as to their results and/or are relatively expensive to produce.

SUMMARY OF THE INVENTION

Accordingly, it is an object of present invention to provide a toner cartridge which avoids the disadvantages of the prior art.

More particularly, it is an object of the present invention to provide a toner cartridge of the above mentioned type which makes possible a complete emptying of the toner content.

In keeping with these objects and with others which will become apparent hereinafter, one feature of present invention resides, briefly stated in a toner cartridge which has a main body, at least one substantially truncated cone-shaped hollow inner body arranged in the interior of the main body and having one end with a smaller diameter opening into the outlet opening of the main body and another end with a greater diameter connected with the end side of the main body, wherein the inner body in the region of its end of a greater diameter has a recess in its wall and the main body is provided on its inner surface with a spiral-shaped rib or groove which provides transportation of the toner to a recess of the inner body during rotation of the cartridge, and the inner body on its inner surface is provided with a spiral-shaped rib or groove which provides transportation of the toner from the recess to the outlet opening during rotation of the cartridge.

The spiral-shaped rib or groove of the main body transports the toner first from the outlet opening back to the recess of the inner body. Through the recess, the toner is supplied into the interior of the inner body, where it is transported by the rib or groove arranged there in an opposite direction to the outlet opening. This transportation process is not dependent on the filling degree of the cartridge.

The radial recess can preferably extend over the half periphery of the end of the greater diameter of the inner body. Thereby it is guaranteed that toner is always transported in a sufficient quantity from the interior of the cartridge to the outlet opening. Moreover, the inventive cartridge is exceptionally simple to produce.

The present invention provides further advantages when the spiral-shaped ribs or grooves of the main body and the inner body have the same pitch. It is then guaranteed that no jamming of toner in certain cartridge regions can be caused. The toner is completely uniformly transported first along the periphery of the main body to the recess of the inner body and then along the inner wall of the inner body to the outlet opening.

The main body can be inserted in a known manner with its end provided with outlet opening into a receptacle of a copier, a fax machine or a printer which is provided with a tooth profile engageable with a periphery of a main body and the main body is rotatably driven.

The outlet opening moreover can be closed by a cover which automatically opens during the insertion of the cartridge into the receptacle. Thereby falling out of the toner during insertion of the cartridge into the device is reliably prevented.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view showing a section of a toner cartridge in accordance with the present invention.

DESCRIPTION OF A PREFERRED EMBODIMENTS

A toner cartridge in accordance with the present invention is identified as a whole with reference numeral 10 and shown in a central longitudinal section in the drawings. The toner cartridge 10 has a hollow-cylindrical main body 11. The main body 11 has an end side 12 which is provided with a central outlet opening 13. The outlet opening 13 has a smaller diameter than the main body 11 and is used for discharging a toner located in the cartridge 10. The end of the main body 11 which is provided with the discharge opening 13 is inserted in a receptacle 14 of a not shown device, for example a copier. The receptacle 14 has a toothed profile 15 which engages the periphery of the main body 11. Because of this engagement, the cartridge 10 can be rotatably driven in direction of the arrow 16.

A hollow inner body 17 which has a shape of a truncated cone is located in the interior of the main body 11. The hollow body 17 has one end with a smaller diameter 18 and opens with this end into the discharge opening 18 of the main body 11, in the region of an end side 12 of the main body 11. The inner body 17 also has an end provided with a greater diameter and connected on its periphery with an opposite end side 20 of the main body 11. A radial recess 21 is provided in a wall of the inner body 17, in the region of the end having the greater diameter 19. The radial recess 21 extends over the half periphery of the inner body 17.

The main body 11 has an inner surface provided with a spiral shaped, protruding rib 22. The rib 22 is formed so as to transport the toner in a transporting direction 23 on the recess 21 when the cartridge rotates in the direction of arrow 16 around its longitudinal axis. The toner is supplied through the recess 21 into the interior of the inner body 17.

The inner body 17 has an inner surface which is also provided with a spiral-shaped rib 24. The spiral-shaped rib

24 extends in an opposite direction to the spiral-shaped rib 22. Therefore when the cartridge 10 rotates in the direction 16, the toner is transported by the rib 24 to the outlet opening 13 and through it outwardly of the cartridge 10. The truncated-cone shaped inner body 17 and the oppositely running, spirals-shaped ribs 22, 24 guarantee that all toner can be transported from the cartridge 10 and no toner residuals remains in the cartridge 10.

It will be understood that each of the elements described above, or two or more together, may also find a useful application in other types of constructions differing from the types described above.

While the invention has been illustrated and described as embodied in toner cartridge, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

I claim:

1. A toner cartridge, comprising a hollow-cylindrical main body which is rotatably driveable about is longitudinal axis and has two opposite end sides, said main body being provided in one of said end sides with an outlet opening having a smaller diameter than a diameter of a remaining part of said main body; and at least one substantially truncated-cone-shaped, hollow inner body arranged in an interior of said main body, said inner body having one end with a smaller diameter opening into said outlet opening of said main body and another end with a greater diameter connected with the other end side of said main body, said inner body in a region of said end of a greater diameter having a radial recess provided in a wall of said inner body, said main body on its inner surface being provided with a spiral-shaped formation which during rotation of the cartridge transports the toner to said recess of said inner body, said inner body on its inner surface being provided with a spiral-shaped formation which during rotation of the cartridge transports the toner from said recess to said outlet opening.

2. A toner cartridge as defined in claim 1, wherein at least one of said formations is formed as a spiral-shaped rib.

3. A toner cartridge as defined in claim 1, wherein at least one of said formations is formed as a spiral-shaped groove.

4. A toner cartridge as defined in claim 1, wherein said radial recess of said inner body extends over a half periphery of said end of a greater diameter of said inner body.

5. A toner cartridge as defined in claim 1, wherein said spiral-shaped formations of said main body and said inner body have a same pitch.

6. A toner cartridge as defined in claim 1; and further comprising means forming a receptacle connected with a toner cartridge using a machine, said one end side of said main body being formed so as to be insertable in said receptacle, said receptacle having a tooth profile which is engageable with a periphery of said main body so that during rotation of said receptacle it rotatably drives said main body.

7. A toner cartridge as defined in claim 6; and further comprising a cover which closes said outlet opening and is formed so that during insertion of the cartridge in said receptacle it automatically opens.

* * * * *